US006145485A

United States Patent [19]

Bidlingmaier et al.

[11] Patent Number: 6,145,485

[45] Date of Patent: Nov. 14, 2000

[54] VARIABLE VALVE OPERATING MECHANISM FOR AN INTERNAL COMBUSTION ENGINE

[75] Inventors: Michael Bidlingmaier, Munich; Gert Fischer, Feldafing; Stefan Foester, Tutzing, all of Germany

[73] Assignee: Bayerische Motoren Werke Aktiengesellschaft, Munich, Germany

[21] Appl. No.: 09/326,710

[22] Filed: Jun. 7, 1999

[30] Foreign Application Priority Data

Jun. 5, 1998 [DE] Germany ..... 198 25 308

[51] Int. Cl.[7] ..... F01L 1/18; F01L 13/00

[52] U.S. Cl. ..... 123/90.16; 123/90.39

[58] Field of Search ..... 123/90.15, 90.16, 123/90.22, 90.23, 90.39, 90.42, 90.43, 90.44, 90.46

[56] References Cited

U.S. PATENT DOCUMENTS

| | | | |
|---|---|---|---|
| 4,249,488 | 2/1981 | Siegla | 123/90.16 |
| 4,459,946 | 7/1984 | Burandt | 123/90.16 |
| 4,572,118 | 2/1986 | Baguena | 123/90.16 |
| 5,111,781 | 5/1992 | Kaku et al. | 123/90.16 |
| 5,732,669 | 3/1998 | Fischer et al. | 123/90.16 |
| 5,791,306 | 8/1998 | Williamson | 123/90.16 |

FOREIGN PATENT DOCUMENTS

| | | |
|---|---|---|
| 0 717 174 | 6/1996 | European Pat. Off. . |
| 44 20 064 | 12/1995 | Germany . |
| 195 32 334 | 3/1997 | Germany . |
| 1 604 707 | 12/1981 | United Kingdom . |

*Primary Examiner*—Weilun Lo
*Attorney, Agent, or Firm*—Evenson, McKeown, Edwards & Lenahan, P.L.L.C.

[57] ABSTRACT

For a variable valve operating mechanism for an internal-combustion engine having variable valve lifts, which can be achieved at constant opening angles, variable valve opening angles are achieved in the case of particularly small valve lifts. To do so, the rocker axis of a valve lever, which is essentially parallel to the axis of rotation of the camshaft, can be dynamically displaced relative to a camshaft along a path in a controlled manner such that, when the rocker axis is displaced, the valve lever is activated for the valve operation by way of a roller which is controlled only approximately from the starting area to the end area of a cam tip of a radial cam on the camshaft.

20 Claims, 3 Drawing Sheets

VARIABLE VALVE OPERATING MECHANISM FOR AN INTERNAL COMBUSTION ENGINE

BACKGROUND AND SUMMARY OF THE INVENTION

This application claims the priority of German application 198 25 308.7, filed in Germany on Jun. 5, 1998, the disclosure of which is expressly incorporated by reference herein.

The invention relates to a variable valve operating mechanism for an internal-combustion engine, in which a lifting valve is operated by a radial cam of a camshaft via a valve actuating lever. By way of a cam plate arranged in its end area away from the valve and by means of a roller which can be displaced in a controlled manner, the valve actuating lever interacts with the radial cam such that the roller, which can be discontinuously displaced transversely to the camshaft axis of rotation against, and in, the rotating direction of the radial cam, is used for changing the opening and closing points in time of the lifting valve. This is done in the case of constant opening angles in combination with variable valve lifts because of the change of the roller-caused valve actuating lever transmission ratios.

A variable valve operating mechanism of this type having a rocker arm is known, for example, from European Patent Document EP 0 717 174 A1. In this known valve operating mechanism, variable valve lifts are achieved by changing the rocker arm transmission ratio which occurs with the controlled change-of the position of the roller from a position close to the rocker axis to a position away from the rocker axis along the cam plate integrated on the rocker arm. As a result of the system, a relative change of the position of the roller with respect to the radial cam interacting with it is also connected with this rocker arm transmission ratio, which is achieved by way of the roller. This is done in such a manner that, in the case of a rocker arm transmission ratio in the direction of smaller rocking angles, the roller engages earlier with the opening flank, and thus the opening and closing points in time of the lifting valve are therefore adjusted to "early". A constant opening angle is connected with the above which exists between the respective opening and closing points in time of the lifting valve as the result of the dimensioning of the radial cam, which opening angle remains constant at each of the achievable reduced valve lifts.

It is a disadvantage of this known valve operating mechanism that, for achieving desired fluid dynamics in the combustion space of the internal-combustion engine for kinematic reasons, no sufficiently low valve lifts can be achieved on the one hand and, on the other hand, the valve opening angles remain constant.

It is an object of the invention to improve a valve operating mechanism of the above-mentioned type such that, particularly in the low load range of the internal-combustion engine, particularly small valve lifts can additionally be achieved at variably adapted valve opening angles.

According to the present application, this and other objects are achieved in that the rocker axis of the valve lever, which is essentially parallel to the axis of rotation of the camshaft, can be dynamically displaced relative to the camshaft along a path in a controlled manner. When the rocker axis is displaced along the path extending transversely to a straight line connecting the roller center with the valve lever support on the shaft end of the lifting valve, the valve lever is activated for the valve operation by way of the roller which is controlled only approximately from the starting area to the end area of the cam tip of the radial cam.

By means of the valve operating mechanism according to the invention, it can be achieved that, with an opening and closing flank of the radial cam moved under the roller fixedly positioned in a controlled manner, at first no valve operation takes place by way of the valve lever escaping because of the displaceable rocker axis. This valve operation will occur only when the roller only approximately from the starting area to the end area of the cam tip of the radial cam activates the valve lever for the valve operation in a controlled manner.

It is an advantage of the invention that the additionally respectively achievable variable valve opening angle is <120° with respect to the crankshaft at variable valve lifts <1.5 mm, particularly when a rocker lever is used as the valve lever.

An advantageous embodiment of the invention has a rocker lever tiltably connected about its rocker axis connected with a lifting cylinder liftably guided along a straight path in a bearing bridge fixedly arranged on the housing. In this case, the lifting cylinder, which is acted upon by a prestressed spring at the end away from the rocker lever, includes in a guiding section, an oblong hole. The oblong hole is dimensioned corresponding to the predetermined lifting displacement of the rocker axis, for the engagement of a stop pin arranged in the bearing bridge. Additionally, a recess is provided in this guiding section for the engagement of an indexing pin which can be triggered for the release of the lifting cylinder which is driven to be liftable against the spring between the ends of the oblong hole in the area of the cam tip of the radial cam by way of the roller and the rocker lever which can be swivelled about the valve-stem-side rocker lever support.

In contrast to known variable valve operating mechanisms with several shiftable valve levers, the present invention has the advantage of a valve operating mechanism with only one rocker lever. In connection with the lifting cylinder, the rocking lever has fewer masses which must be moved than the known-prior art.

The above-described basic construction of the valve operating mechanism according to the invention advantageously permits a further development having a single camshaft with radial cams for the inlet and outlet lifting valves, comprising a rocker lever for an outlet lifting valve, which rocker lever is disposed on a rocker lever shaft arranged fixed to the housing. In this case, the control shaft is provided between the rocker lever shaft and the camshaft arranged, relative to the latter, deeper in a cylinder head. This control shaft operates the roller between the radial inlet cam and the rocker lever with the rocker axis, which can be displaced in a controlled manner, for the variable operation and control of the inlet lifting valve preferably in the lower load range of the internal-combustion engine, particularly in the partial load range close to idling.

In addition to an advantageous compact construction of the valve operating mechanism according to the invention, by means of this valve operating mechanism, the air flowing into a combustion space can, in a further advantageous manner, be provided with a swirling motion to form a better mixture.

In a further development of the invention, this applies particularly to a cylinder head with two inlet lifting valves per combustion space, the assigned rocker levers have a displaceable rocker axis, each of which is arranged to be separately controllable such that one of the lifting valves is variably controlled with a constant opening angle with respect to an inlet/outlet overlap and a valve lift, and the other lifting valve is variably controlled with a variable valve opening angle <100° with respect to the crankshaft with valve lifts <1.1 mm.

As a result, by generating a swirl in the combustion space in a targeted manner, an improved combustion can be advantageously achieved, while reducing the fuel consumption.

Other objects, advantages and novel features of the present invention will become apparent from the following detailed description of the invention when considered in conjunction with the accompanying drawings.

DETAILED DESCRIPTION OF THE DRAWINGS

Figure 1:
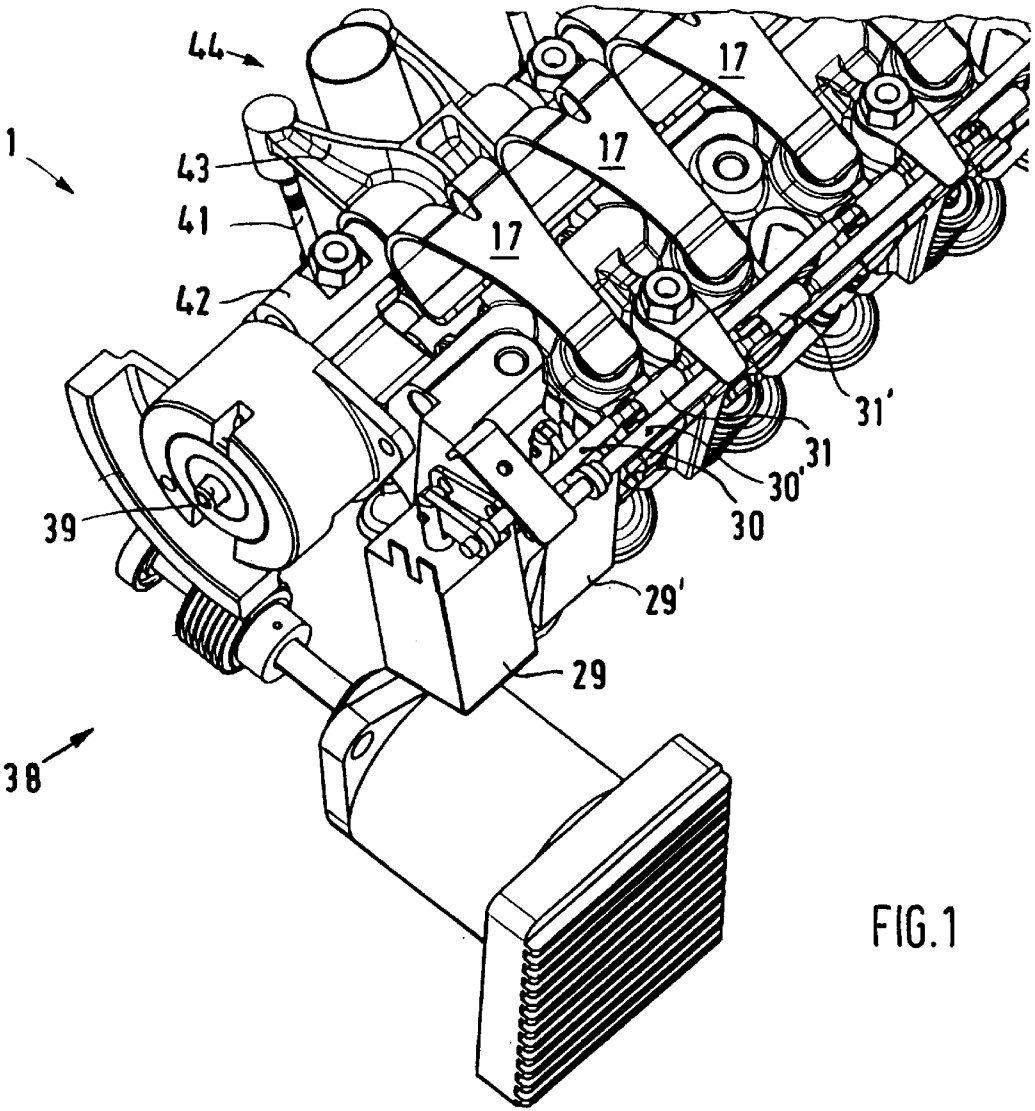
FIG. 1 is a cutout view of an arrangement of the valve operating mechanism according to the invention in a cylinder head of an internal-combustion engine (not shown in detail)

In a variable valve operating mechanism 1 for an internalcombustion engine (not shown in detail), a lifting valve 2, 2' is operated by one radial cam 3 respectively of a camshaft 4. A single one-piece rocker arm 5 which, by way of a cam plate 6 arranged in its end area away from the lifting valve interacts with the radial cam 3 through a roller 7 which can be displaced in a controlled manner. By means of the roller 7, which can be discontinuously displaced transversely to the axis of rotation 8 of the camshaft against and in the rotating direction of the radial cam 3, the change of the opening and closing points in time of the lifting valve 2, 2' is achieved at constant valve opening angles in combination with variable valve lifts because of the change of the roller-caused rocker lever transmission ratios, as shown, for example, by the group of lifting curves which are illustrated on top in FIG. 3.

According to the object of the invention, this valve operating mechanism 1 is improved such that, particularly in low load ranges of the internal-combustion engine, particularly small variable valve lifts are achieved at variable valve opening angles.

According to the invention, the rocker axis 9 of the rocker lever 5, which is essentially parallel to the axis of rotation 8 of the camshaft, can be dynamically displaced relative to the camshaft 4 along a path 10. This is done in such a manner that, when the rocker axis 9 is displaced along the path 10 extending transversely to a straight connection line 11 of the roller center 12 with the valve lever support 13 on the shaft end of the lifting valve 2, 2', the valve lever 5 is activated for operating the valve by way of the roller 7. The roller 7 is controlled only approximately from the starting area to the end area of the cam tip 14 of the radial cam 3.

Figure 3:
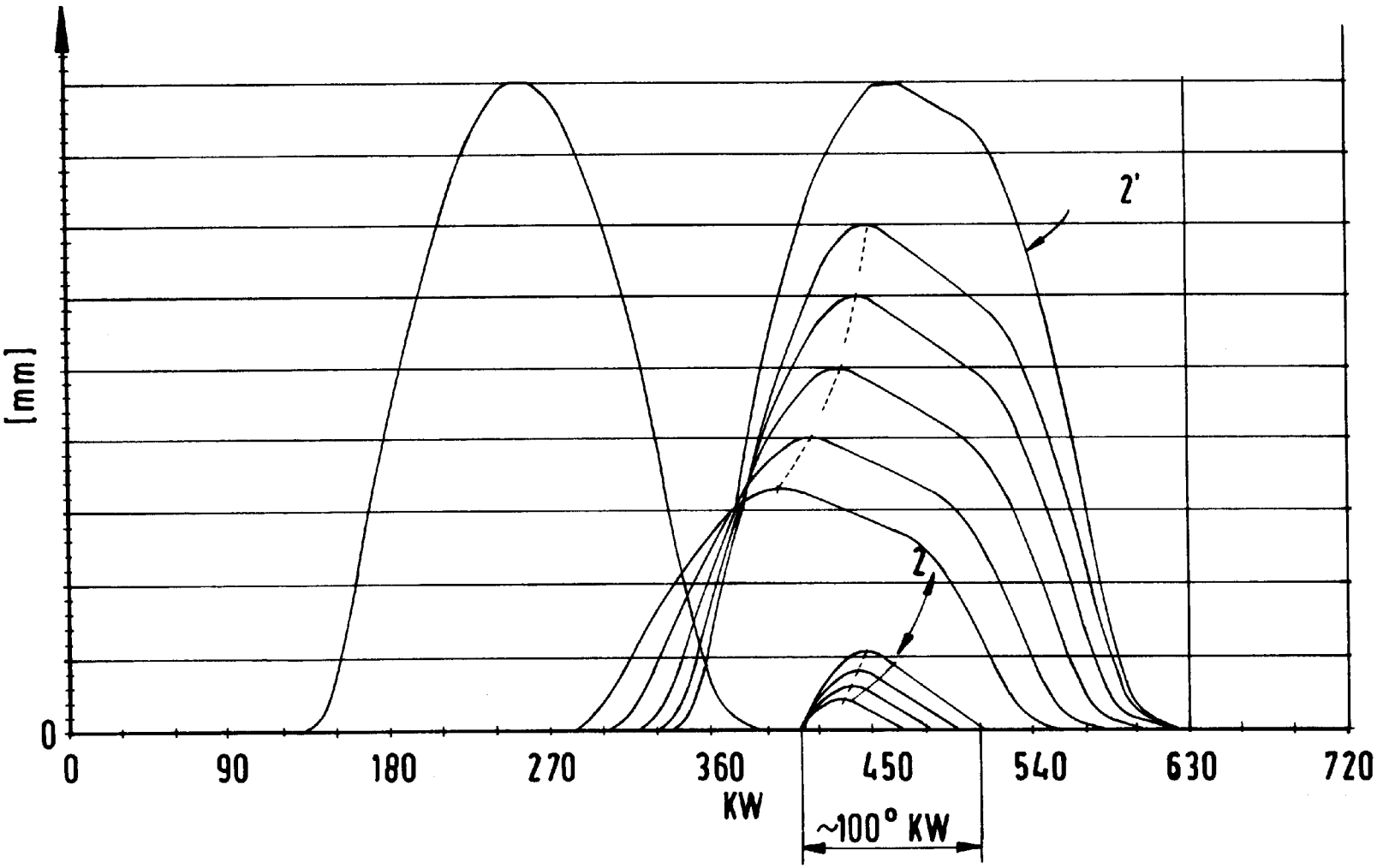
FIG. 3 is a graph of lifting courses which can be achieved by the valve operating mechanism according to the invention, preferably for one or more inlet valves.

By means of the variable valve operating mechanism 1 further developed according to the invention, advantageously an additional variable valve opening angle <120° with respect to the crankshaft at variable valve lifts <1.5 mm is achieved, as indicated, for example, in FIG. 3, by way of the group of lifting curves close to the abscissa.

A further development, which is constructively advantageous with respect to a small installation space and which has low valve operating masses, is achieved in that the rocker lever 5 is tiltably connected about its rocker axis 9 with a lifting cylinder 16 liftably guided along a straight path 10 in a bearing bridge 15 fixedly arranged on the housing. In this case, the lifting cylinder 16, which is acted upon by a prestressed spring 17 at the end away from the rocker lever, includes an oblong hole 18 in a guiding section. The hole is dimensioned corresponding to the predetermined lifting displacement of the rocker axis 9. The guiding section engages a stop pin 19 arranged in the bearing bridge 15. In addition, a recess 20 is provided in this guiding section for engagement with play of an indexing pin 21. This indexing pin 21 can be triggered for the release of the lifting cylinder 16 which is driven to be liftable against the spring 17 between the ends of the oblong hole 18 in the area of the cam tip 14 of the radial cam 3 by way of the roller 7 and the rocker lever 5. The rocker lever 5 can be swivelled about the valve-stem-side rocker lever support 13, in which case the rocker lever 5 does not operate the lifting valve 2, 2'.

To achieve a low construction, the lifting cylinder 16 is advantageously acted upon by a bow spring 17 and, for achieving an essentially noise-free valve operating mechanism, is supported by way of a hydraulic valve play compensation element or HVA 22 on a hinge block 23 interacting with the rocker lever 5 by way of cylindrical hinge surfaces. For supplying oil to the HVA 22, the hollow stop pin 19 arranged in a diametrically aligned manner with respect to the indexing pin 21 communicates with an oil pan 24 of a distributor pipe 25. The pipe 25 is constructed in the bearing bridge 15 for forwarding the oil by way of an opening 26 of the lifting cylinder 16 provided in the oblong hole 18 in its interior 27 connected with the HVA 22. The interior is ventilated on the spring side by way of a device provided in a lock 28. By means of the prestressed bow spring 17, a form closure is ensured of the components participating in the displacement of the rocker axis 9.

For controlled dynamic displacement of the rocker axis 9, a triggerable operating device 29, 29' acts by way of an angularly adjustable shifting shaft 30, 30' with a non-rotatably arranged spring-elastic lever 31, 31' in a driving manner upon the respective indexing pin 21. In this case, in the phase of the operation of the lifting valve 2, 2' while the indexing pin 21 is blocked by way of the lifting cylinder 16 and the operating device 29, 29' is simultaneously triggered, the spring-loaded lever 31, 31' is prestressed by way of the shifting shaft 30, 30'. The prestressing is such that, when the base circle phase of the roller 7 on the radial cam 3 is reached, the indexing pin 21 is disengaged from the recess 20 in the lifting cylinder 16 and is held in the disengaged position by way of the lever 31, 31'.

As a result, the rocker axis 9 fixed in the hinge block 23 of the rocker lever 9 can be liftably guided corresponding to the rotating radial cam 3 between the ends of the oblong hole 18. When the lower end of the oblong hole 18 is reached, the free swivelling movement of the rocker lever 5 about its rocker lever support 13 on the shaft end of the lifting valve 2, 2' is terminated. Therefore, the roller 7 at the end of the opening flank from the starting area to the end area of the cam tip 14 of the radial cam 3 activates the rocker lever 5 for operating the lifting valve 2, 2' and is subsequently inoperative again in the area of the closing flank with respect to a valve lifting operation.

To further simplify the mounting of the flat bow spring 17 which, on the one hand, is tailored to the HVA 22 and, on the other hand, is tailored to the restoring spring, which is not shown, of the pertaining lifting valve 2, 2', the bow spring 17 acting upon the lifting cylinder 16 is arranged to extend at a short distance above the bearing bridge 15. The spring is fastened by way of a lug-type end section 32 on a lateral face 33 of the bearing bridge 15 via a screwed connection 34 aligned with the stop pin 19. This screwed connection 34 is also used as a stop for a prestressed pressure spring 35. The spring 35 is for the stop pin 19 which is slidably arranged in the bearing bridge 15. For an easier demounting of the stop pin 19, which is hollow for oil-guiding purposes, this stop pin 19 may be provided with a thread on its interior side, for the application of a demounting screw (not shown).

Figure 2:
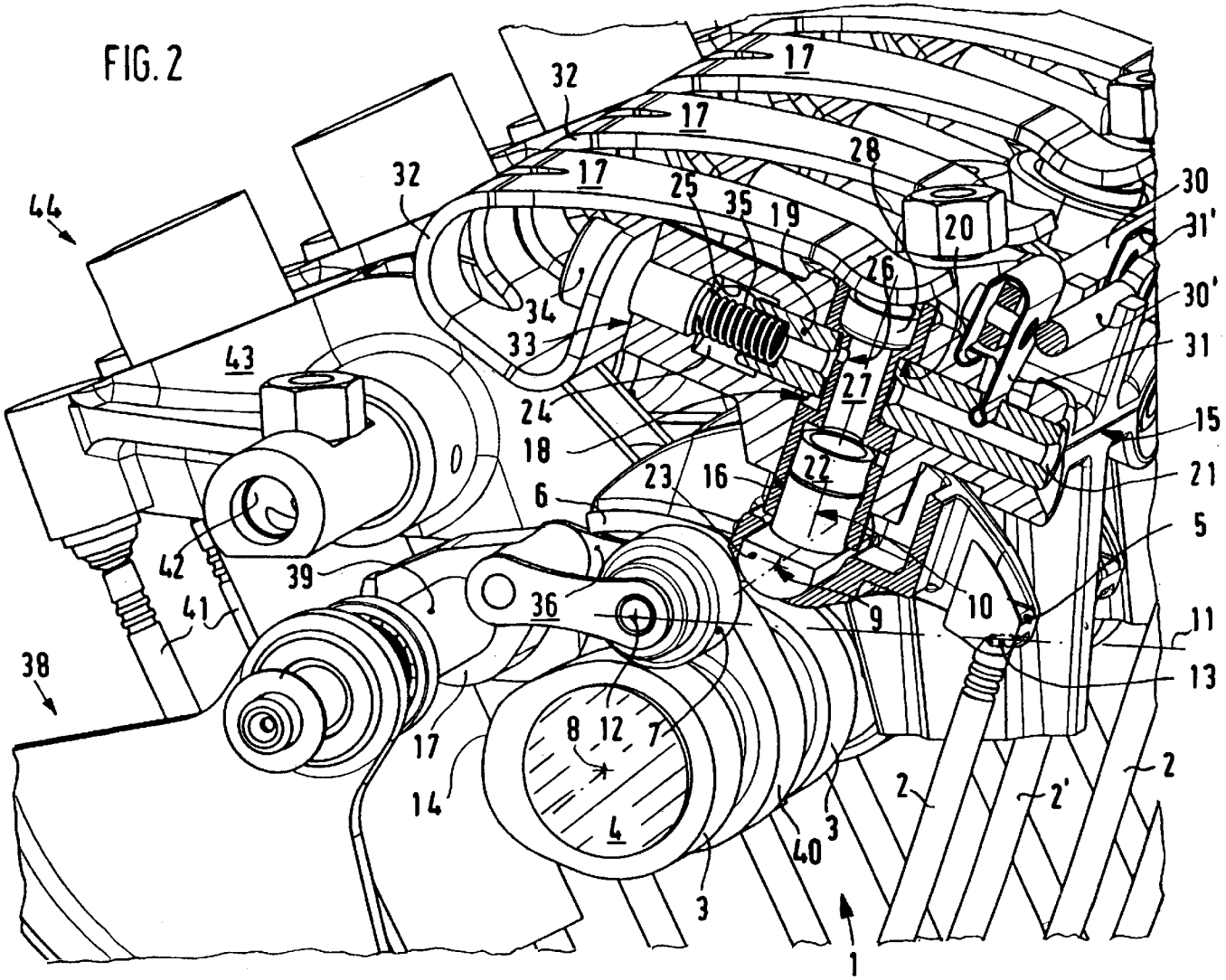
FIG. 2 is an enlarged view of a valve operating mechanism according to the invention with a sectional view of the device

As also illustrated in FIG. 2, the roller 7 is drivingly connected, by way of control arms 36 applied to both sides of the roller, with a control arm 37 of a control shaft 39. The shaft 39 can be discontinuously driven by way of a worm gear 38 in a motor-driven manner. In this case, each radial cam 3 interacting with the roller 7 has a ramp-type section which is situated behind the cam tip 14 and in front of the closing flank. In the case of a cam plate 6 constructed concentrically with respect to the axis of rotation 8 of the camshaft, on the rocker lever according to FIG. 3, this ramp-type section causes in the case of every lifting curve of the upper group of lifting curves, a course which slopes down in a roof-shape manner behind the peak of the curve. By way of the ram-type section in conjunction with the rocker lever kinematics, this roof-shaped course is selected such that the valve opening angles of the group of lifting curves close to the abscissa according to the invention are preferably <100° with respect to the crankshaft.

For achieving an advantageously compact valve operating mechanism 1, a single camshaft 4 is used which has radial cams 3, 40 for inlet and outlet lifting valves 2, 2' and 41 with a rocker lever 43 for an outlet lifting valve 41. The rocker lever 43 is disposed on a rocker lever shaft 42 fixedly mounted to the housing. Between the rocker lever shaft 42 and the camshaft 4 which is arranged at a lower height in a cylinder head 44 relative to the rocker lever shaft 42, the control shaft 39 is provided for operating the roller 7 between the radial inlet cam 3 and the rocker lever 5 with a controlled displaceable rocker axis 9 for the variable operation or variable control of the inlet lifting valve 2, 2'.

The above-described compact arrangement is particularly advantageous if, in the case of a cylinder head 44 with two inlet lifting valves 2, 2' per combustion space, the assigned rocker levers 5 with the displaceable rocker axis 9 are in each case arranged to be separately triggerable. They are triggered by way of the operating devices 29, 29' such that one of the lifting valves 2' with a constant opening angle is variably controlled with respect to an inlet/outlet overlap and a valve lift, and that the other lifting valve 2 according to the invention is variably controlled with a variable valve opening angle <100° with respect to the crankshaft with valve lifts <1.1. mm. Thus, the internal-combustion engine, which is not shown, can be operated in an advantageous manner with respect to fuel consumption in the low load range, particularly in the partial load range close to idling, as the result of a targeted swirl formation of the charge in a combustion space.

Within the scope of the invention, the rocker axis 9 can also be displaceable along a curved path. In addition, both lifting valves 2, 2' can be correspondingly synchronously operated for each group of curves illustrated in FIG. 3.

Further, within the scope of the invention, a drag lever can be used as the valve lever.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Variable valve operating mechanism for an internal-combustion engine, comprising:

a lifting valve operated by a radial cam of a camshaft via a valve actuating lever, said valve actuating lever interacting with the radial cam by way of a cam plate arranged in an end area away from the valve and by way of a roller which is displaceable in a controlled manner;

wherein the roller, which is discontinuously displaceable transversely to a camshaft axis of rotation against, and in, a rotating direction of the radial cam, is used for changing opening and closing points in time of the lifting valve for constant opening angles in combination with variable valve lifts because of a change of roller-caused valve actuating lever transmission ratios; and wherein a rocker axis of the valve actuating lever which is substantially parallel to the camshaft axis of rotation, is dynamically displaceable relative to the camshaft along a path in a controlled manner such that, when the rocker axis is displaced along the path extending transversely to a straight line connecting a center of the roller and a valve lever support on a shaft end of the lifting valve, the valve actuating lever is activated for the valve operation by way of the roller which is controlled only approximately from a starting area to an end area of a cam tip of the radial cam.

2. Valve operating mechanism according to claim 1, wherein a variable valve opening angle of <120° with respect to a crankshaft at variable valve lifts <1.5 mm is achieved when a rocker lever is used as a valve actuating lever.

3. Valve operating mechanism according to claim 1, wherein the valve actuating lever is a rocker lever which is tiltably connected about its rocker axis with a lifting cylinder which is liftably guided along a straight path in a bearing bridge fixedly arranged on a housing;

further wherein the lifting cylinder, which is acted upon by a prestressed spring at an end away from the rocker lever, comprises in a guiding section:

an oblong hole, which is dimensioned corresponding to a predetermined lifting displacement of the rocker axis, in order to engage a stop pin arranged in the bearing bridge, and a recess in the guiding section for engaging with play an indexing pin which is triggerable for releasing the lifting cylinder which is driven to be liftable against the spring between the ends of the oblong hole in the area of the cam tip of the radial cam by way of the roller and the rocker lever which can be swivelled about the valve-stem-side rocker lever support.

4. Valve operating mechanism according to claim 2 wherein said rocker lever is tiltably connected about its rocker axis with a lifting cylinder which is liftably guided along a straight path in a bearing bridge fixedly arranged on a housing;

further wherein the lifting cylinder, which is acted upon by a prestressed spring at an end away from the rocker lever, comprises in a guiding section:

an oblong hole, which is dimensioned corresponding to a predetermined lifting displacement of the rocker axis, in order to engage a stop pin arranged in the bearing bridge, and a recess in the guiding section for engaging with play an indexing pin which is triggerable for releasing the lifting cylinder which is driven to be liftable against the spring between the ends of the oblong hole in the area of the cam tip of the radial cam by way of the roller and the rocker lever which can be swivelled about the valve-stem-side rocker lever support.

5. Valve operating mechanism according to claim 3, wherein the lifting cylinder, which is acted upon by a bow spring, is supported by way of a hydraulic valve play compensation element on a hinge block interacting with the rocker lever by way of cylindrical hinge surfaces; and wherein for supplying oil to the compensation element, a hollow stop pin arranged in a diametrically aligned manner with respect to an indexing pin communicates with an oil chamber of a distributor pipe constructed in a bearing bridge for forwarding oil by way of an opening of the lifting cylinder provided in the oblong hole in its interior connected with the compensation element, which interior is ventilated on the spring side by way of a device provided in a lock.

6. Valve operating mechanism according to claim 4, wherein the lifting cylinder, which is acted upon by a bow spring, is supported by way of a hydraulic valve play compensation element on a hinge block interacting with the rocker lever by way of cylindrical hinge surfaces; and wherein for supplying oil to the compensation element, a hollow stop pin arranged in a diametrically aligned manner with respect to an indexing pin communicates with an oil chamber of a distributor pipe constructed in a bearing bridge for forwarding oil by way of an opening of the lifting cylinder provided in the oblong hole in its interior connected with the compensation element, which interior is ventilated on the spring side by way of a device provided in a lock.

7. Valve operating mechanism according to claim 3, wherein a triggerable operating device acts by way of an angularly adjustable shifting shaft with a non-rotatably arranged spring elastic lever in a driving manner upon a respective indexing pin; and further wherein, in an operating phase of the lifting valve while the indexing pin is blocked by way of a lifting cylinder and the operating device is simultaneously triggered, by way of the shifting shaft, the respective spring-loaded lever is prestressed such that when a base circle phase of the roller on the radial cam is reached, the indexing pin is disengaged from the recess in the lifting cylinder and is held in the disengaged S position by way of the respective lever.

8. Valve operating mechanism according to claim 5, wherein a triggerable operating device acts by way of an angularly adjustable shifting shaft with a non-rotatably arranged spring-elastic lever in a driving manner upon a respective indexing pin; and further wherein, in an operating phase of the lifting valve while the indexing pin is blocked by way of a lifting cylinder and the operating device is simultaneously triggered, by way of the shifting shaft, the respective spring-loaded lever is prestressed such that when a base circle phase of the roller on the radial cam is reached, the indexing pin is disengaged from the recess in the lifting cylinder and is held in the disengaged position by way of the respective lever.

9. Valve operating mechanism according to claim 6, wherein a triggerable operating device acts by way of an angularly adjustable shifting shaft with a non-rotatably arranged spring-elastic lever in a driving manner upon a respective indexing pin; and further wherein, in an operating phase of the lifting valve while the indexing pin is blocked by way of a lifting cylinder and the operating device is simultaneously triggered, by way of the shifting shaft, the respective spring-loaded lever is prestressed such that when a base circle phase of the roller on the radial cam is reached, the indexing pin is disengaged from the recess in the lifting cylinder and is held in the disengaged position by way of the respective lever.

10. Valve operating mechanism according to claim 3, wherein the spring acting upon the lifting cylinder is arranged to extend at a short distance above the bearing bridge and is fastened by way of a lug-type end section on a lateral face of the bearing bridge via a screwed connection aligned with the stop pin, which screwed connection is also used as a stop of a prestressed pressure spring for the stop pin slidably arranged in the bearing bridge.

11. Valve operating mechanism according to claim 5, wherein the bow spring acting upon the lifting cylinder is arranged to extend at a short distance above the bearing bridge and is fastened by way of a lug-type end section on a lateral face of the bearing bridge via a screwed connection aligned with the stop pin, which screwed connection is also used as a stop of a prestressed pressure spring for the stop pin slidably arranged in the bearing bridge.

12. Valve operating mechanism according to claim 7, wherein the spring acting upon the lifting cylinder is arranged to extend at a short distance above the bearing bridge and is fastened by way of a lug-type end section on a lateral face of the bearing bridge via a screwed connection aligned with the stop pin, which screwed connection is also used as a stop of a prestressed pressure spring for the stop pin slidably arranged in the bearing bridge.

13. Valve operating mechanism according to claim 3, wherein by way of control arms applied to both sides, the roller is in a driving connection with a control arm of a control shaft which can be discontinuously motor-driven by way of a worm gear;

wherein each radial cam interacting with the roller has a ramp-type section behind the cam tip and in front of the closing flank, and in addition, wherein the cam plate of the rocker lever is constructed concentrically with respect to the axis of rotation of the camshaft.

14. Valve operating mechanism according to claim 5, wherein by way of control arms applied to both sides, the roller is in a driving connection with a control arm of a control shaft which can be discontinuously motor-driven by way of a worm gear;

wherein each radial cam interacting with the roller has a ramp-type section behind the cam tip and in front of the closing flank, and in addition, wherein the cam plate of the rocker lever is constructed concentrically with respect to the axis of rotation of the camshaft.

15. Valve operating mechanism according to claim 7, wherein by way of control arms applied to both sides, the roller is in a driving connection with a control arm of a control shaft which can be discontinuously motor-driven by way of a worm gear;

wherein each radial cam interacting with the roller has a ramp-type section behind the cam tip and in front of the closing flank, and in addition, wherein the cam plate of the rocker lever is constructed concentrically with respect to the axis of rotation of the camshaft.

16. Valve operating mechanism according to claim 10, wherein by way of control arms applied to both sides, the roller is in a driving connection with a control arm of a control shaft which can be discontinuously motor-driven by way of a worm gear;

wherein each radial cam interacting with the roller has a ramp-type section behind the cam tip and in front of the closing flank, and in addition, wherein the cam plate of the rocker lever is constructed concentrically with respect to the axis of rotation of the camshaft.

17. Valve operating mechanism according to claim 1, wherein a single camshaft has radial cams for inlet and outlet lifting valves respectively, the mechanism further comprising a rocker lever for an outlet lifting valve, which rocker lever is disposed on a rocker lever shaft arranged fixed to the housing; and wherein between the rocker lever shaft and the camshaft, which is arranged lower in a cylinder head relative to the rocker lever shaft, a control shaft is provided for operating the roller between the radial inlet cam and the rocker lever with a controlled displaceable rocker axis for the variable operation or variable control of the inlet lifting valve.

18. Valve operating mechanism according to claim 1, wherein for a cylinder head with two inlet lifting valves per combustion space, assigned rocker levers with the displaceable rocker axis are in each case arranged to be separately triggerable such that one of the lifting valves with a constant opening angle is variably controlled with respect to an inlet/outlet overlap and a valve lift; and wherein the other lifting valve is variably controlled with a variable valve opening angle <100° with respect to the crankshaft with valve lifts <1.1 mm.

19. Valve operating mechanism according to claim 18, wherein the second lifting valve with a variable valve opening angle is triggered in a lower load range of the internal-combustion engine.

20. Valve operating mechanism according to claim 19, wherein the lower load range is a partial load range close to idling.

* * * * *